US007631868B2

(12) United States Patent
Dunham

(10) Patent No.: US 7,631,868 B2
(45) Date of Patent: Dec. 15, 2009

(54) SCUFFER APPARATUS AND METHOD

(75) Inventor: Brian J. Dunham, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 282 days.

(21) Appl. No.: 11/418,704

(22) Filed: May 5, 2006

(65) Prior Publication Data

US 2007/0257425 A1 Nov. 8, 2007

(51) Int. Cl.
*B65H 9/04* (2006.01)

(52) U.S. Cl. ..... 271/253; 271/254; 271/226; 271/228; 271/243; 271/246

(58) Field of Classification Search ..... 271/115, 271/253, 254, 243, 246
See application file for complete search history.

(56) References Cited

U.S. PATENT DOCUMENTS 4,743,129 A * 5/1988 Keryhuel et al. ..... 400/582
5,203,846 A * 4/1993 Kuhns et al. ..... 271/125
6,091,929 A 7/2000 Yamazaki et al.
6,168,153 B1 * 1/2001 Richards et al. ..... 271/227
6,494,451 B2 * 12/2002 Michel ..... 271/274
6,722,650 B1 * 4/2004 Abbata et al. ..... 271/213
6,722,653 B1 * 4/2004 Brumberger et al. ..... 271/303
6,856,785 B1 2/2005 Schwenk et al.
6,908,079 B2 * 6/2005 Milillo et al. ..... 270/58.08
2004/0256782 A1 * 12/2004 Milillo et al. ..... 270/58.01

* cited by examiner

*Primary Examiner*—Patrick H Mackey
*Assistant Examiner*—Howard Sanders

(57) ABSTRACT

A retractable scuffer includes an arm with foldaway drive wheels connected thereto that are independently pivotable to ensure even drive force on a sheet. The drive wheels flips down in a counter clockwise direction as the scuffer arm is driven to an extended position by a lead screw mechanism. This provides a shallow angle of contact with the sheet and allows the sheet to be pulled against a registration gate by the drive wheels versus being pushed, thereby eliminating unwanted reaction forces inherent in existing systems that push a sheet against a registration gate.

12 Claims, 10 Drawing Sheets

SCUFFER APPARATUS AND METHOD

This invention relates in general to an image forming apparatus, and more particularly, to an image forming apparatus employing an improved scuffing system.

Typically, in an electrophotographic printing process of printers, such as, U.S. Pat. No. 6,091,929, which is incorporated herein by reference to the extent necessary to practice the present disclosure, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to the donor roll is then deposited on latent electrostatic images on a charge retentive surface, which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

A finisher is usually arranged in a post processing position to receive the fused copy substrates or sheets and staple them, if desired. In many such finishing, tamping systems are commonly used to register the sheets in compiler trays. Walls or tamper arms on the sides of the tray can be moved repeatedly and reversibly against one or more sides of an incoming sheets or sets of sheets, thereby achieving proper alignment and square stacking. Once squared, sheet stacks are more accurately manipulated, such as, for example, by stapling or hole-punching.

In most conventional systems used for printers, copiers, and facsimile machines, the types of substrates being transported usually do not vary much. Most systems typically encounter only a limited number of different substrate types, such as, for example, A4 or 8.5"×11" papers. Proper registration of these papers ensures high quality during the image forming and sheet processing process. Further, image-forming systems may utilize primary and secondary systems during the image forming process to keep substrates properly aligned. For example, substrates could be initially registered prior to image transfer and later during the compiling process.

However, the primary registration system often used in many set compiler subsystems cannot be used for certain sheet types or when two or more sheet sizes are use in combination. Further the ability to use a secondary registration system in combination with the primary registration system is often limited by the paper path architecture and space constraints, which often requires that the secondary registration system get out of the way of the incoming sheet between sheets and/or between sets. Subsequently, the paper path is often designed in a way that only a stationary registration system can be used. In addition, using a secondary registration system only when needed can help to reduce its wear, extend its replacement life and/or allow its design to be made more economical and/or less robust. Also, using a secondary registration device only when needed, when such a secondary device is a friction type device, can help reduce marking and/or smearing of substrates when it is not used, especially for those substrates that are prone to marking an/or smearing.

A registration system approach that helps to minimize the footprint and help maximize the efficiency of space used in finishing deceives, especially in high volume type finishing applications is disclosed in U.S. Pat. No. 6,856,785 B1, issued Feb. 15, 2005 to Alicia K. Schwenk et al. which discloses a registration system including both a primary tamping device and a secondary scuffing device. The scuffing device includes a scuffer arm, an extending/retractable device, a drive subsystem, and an engagement control device. In various exemplary embodiments, the secondary scuffing device is retracted. The scuffing device can thus be used, when required, to register a substrate in the process direction and then retracted enabling the side tampers to cross process register the substrates.

While this patent answered most of the above-mentioned problems, due to space constraints and paper path architecture, when the scuffer descends down onto its scuffing platform it provides a "pushing" action to sheets and is at too steep of an angle to reliably register a wide variety of incoming sheets. Also, having two drive rolls on a single drive shaft makes it very difficult to ensure equal normal force on each roll.

Obviously, there is still a need for an improved finishing registration system apparatus and method.

Accordingly, an improved scuffing system is disclosed that provides foldaway or flip-up drive rollers with independent suspension that solves the above-mentioned problems. The scuffer has two drive rolls with independent suspensions to ensure even drive force on a sheet. The scuffer extends down driven with a lead screw mechanism. Drive rolls of the scuffer flip down in a counter clockwise direction, thus providing a shallower scuffing angle toward the sheet than heretofore possible, thereby allowing the sheet to be "pulled" against a registration edge versus being "pushed." This eliminates unwanted reaction forces and ensures a constant nip force during scuffing.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific embodiments, including the drawing figures (which are approximately to scale) wherein.

Figure 1:
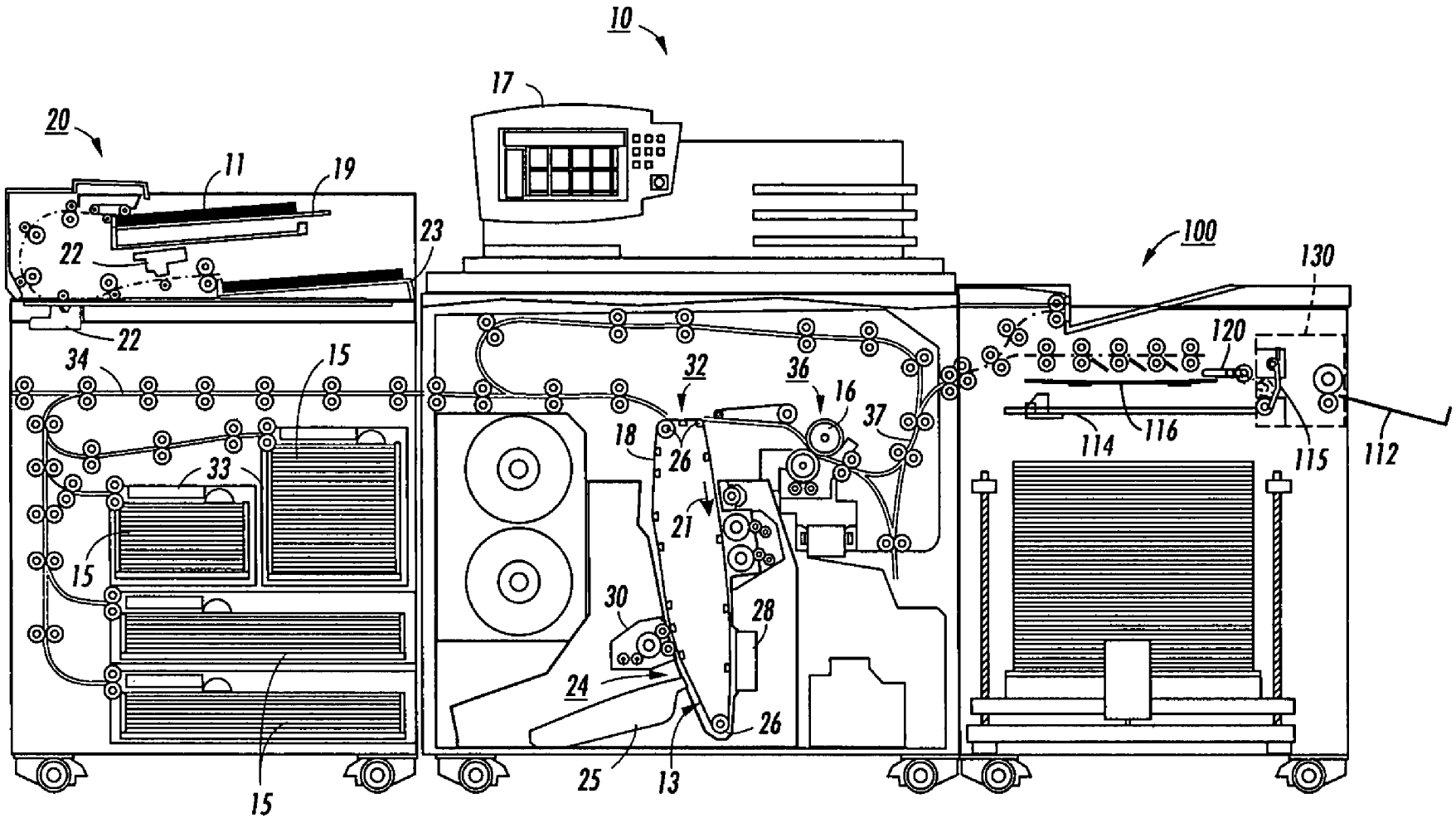
FIG. 1 is an exemplary modular xerographic printer that includes an exemplary finisher system with a scuffer apparatus in accordance with the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes an improved finishing system.

For a general understanding of the features of the disclosure, reference is made to the drawings. In the drawings, like reference numerals have been used throughout to identify identical elements.

Referring to the FIG. 1 printer 10, as in other xerographic machines, such as in U.S. Pat. No. 6,819,906 issued Douglas Herrmann et al. on Nov. 16, 2004, which is included herein by reference, an electronic document or an electronic or optical image of an original document or set of documents to be reproduced may be projected or scanned onto a charged surface 13 or a photoreceptor belt 18 to form an electrostatic latent image. Optionally, an automatic document feeder 20 (ADF) may be provided to scan at a scanning station 22 paper documents 11 fed from a tray 19 to a tray 23. The latent image is developed with developing material to form a toner image corresponding to the latent image. The toner image is then electrostatically transferred to a final print media material, such as, paper sheets 15, to which it may be permanently fixed by a fusing device 16. The machine user may enter the desired printing and finishing instructions through the graphic user interface (GUI) or control panel 17, or, with a job ticket, an electronic print job description from a remote source, or otherwise.

As the substrate passes out of the nip, it is generally self-stripping except for a very lightweight one. The substrate requires a guide to lead it away from the fuser roll. After separating from the fuser roll, the substrate is free to move along a predetermined path toward the exit of the printer 10 in which the fuser structure apparatus is to be utilized.

The belt photoreceptor 18 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and transfer station 32. A sheet 15 is fed from a selected paper tray supply 33 to a sheet transport 34 for travel to the transfer station 32. Paper trays 33 include trays adapted to feed the long edge of sheets first from a tray (LEF) or short edge first (SEF) in order to coincide with the LEF or SEF orientation of documents fed from tray 11 that is adapted to feed documents LEF or SEF depending on a user's desires. Transfer of the toner image to the sheet is affected and the sheet is stripped from the photoreceptor and conveyed to a fusing station 36 having fusing device 16 where the toner image is fused to the sheet. The sheet 15 is then transported by a sheet output transport 37 to the finishing station 100 where plural sheets 15 may be accumulated to be compiled into superposed sets or sheets and optionally fastened together (finished) by being stapled, folded, bound, or the like.

Figure 2:
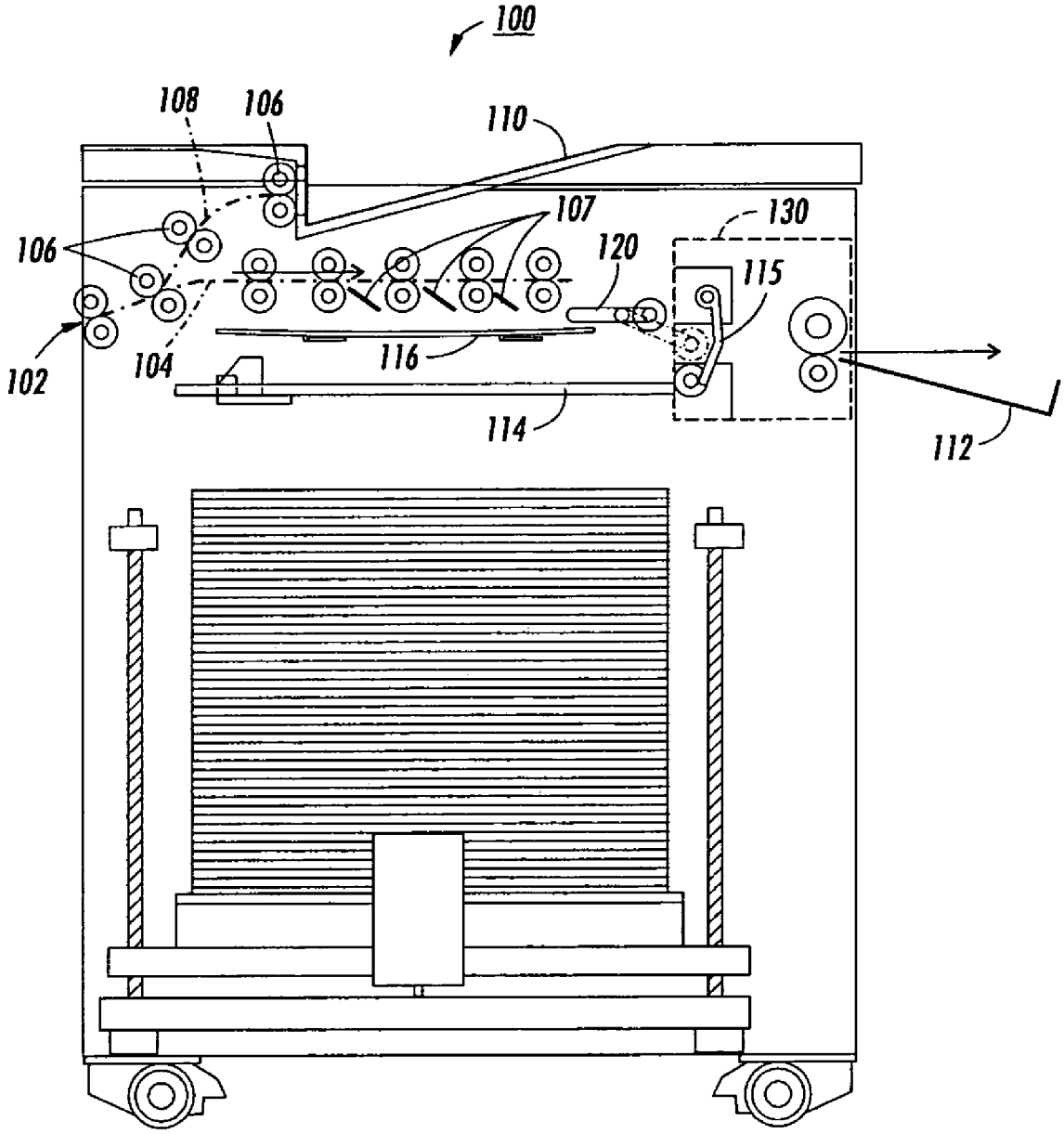
FIG. 2 is a block diagram of one exemplary embodiment of a finisher module.

FIG. 2 illustrates one exemplary embodiment of the finisher module 100. As shown in FIG. 2, the finisher module 100 includes a sheet receiving inlet 102, a main transport path 104, a bypass path 108, a top bypass tray 110, an optional temporary compiler or sheet buffering station 116, a compiling platform 114, a retractable scuffing system 120, a manipulation device 130, a sheet lead edge registration gate 115 and output tray 112. A number of pairs of transport nip rollers 106 move the sheets along the main transport path 104.

Manipulation device 130 can be any device capable of manipulating a sheet or a set of sheets, including, but not limited to, stapling, punching, stitching, perforating and/or the like. It should be appreciated that the manipulation device 130 may or may not be included in the finisher module 100 and that the location and/or capability or the manipulation device 130 is a design choice and will be obvious to those skilled in the art.

In operation, sheets are received from the image portion of printer 10 though the sheet receiving inlet 102. Sheets are transported along the main transport path 104 by one or more nips of pairs of transport rollers 106. Sheets not compiled into sets can be diverted to the top bypass tray 110 along the bypass path 108. Otherwise, sheets are transported along the main transport path 104 by the one or more pairs of transport nip rollers 106. Sheets not compiled into sets can be diverter to the top bypass tray 110 along the bypass path 108. Otherwise, sheets are transported along the main transport path 104 and are diverted to the compiler platform 114 by an appropriate one of a number of gates 107 that divert the sheets to the compiling platform 114. In various exemplary embodiments for each sheet, the appropriate gate 107 is selected based on a length of that sheet.

Sheets to be compiled are received by compiling the platform 114. As each sheet is received, the compiling platform 114 registers the sheet laterally and/or along the process direction by using a scuffing system 120 (shown in FIGS. 3-10) and/or one or more tamping devices and lead edge registration gates 115, which are made capable of pivoting and or moving out of the way of the sheets as they exit to output tray 112. The compiling platform 114 continues to receive sheets and to register the sheets until the desired number of sheets in a set is received. The compiled and registered set can be manipulated by the manipulation device 130. Whether manipulated or not, the compiled and registered set of sheets is then output from the finished module 100 to output tray 112 or, alternatively, can be dropped to a stacking device positioned below the compiling platform 114.

Figure 3:
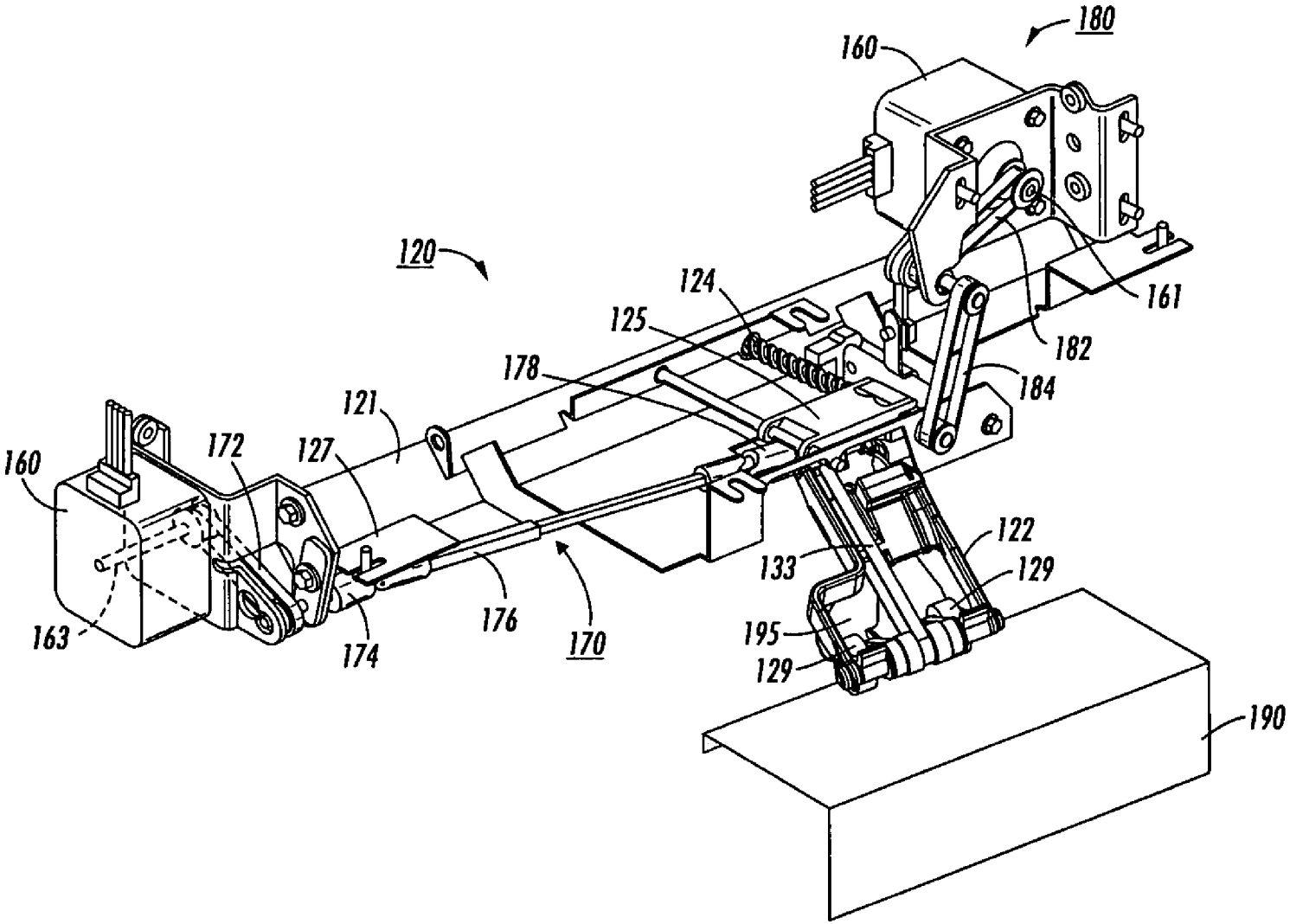
FIG. 3 shows in greater detail a first exemplary embodiment of a retractable scuffer registration device of the present disclosure where the retractable scuffer registration device has been extended.
Figure 4:
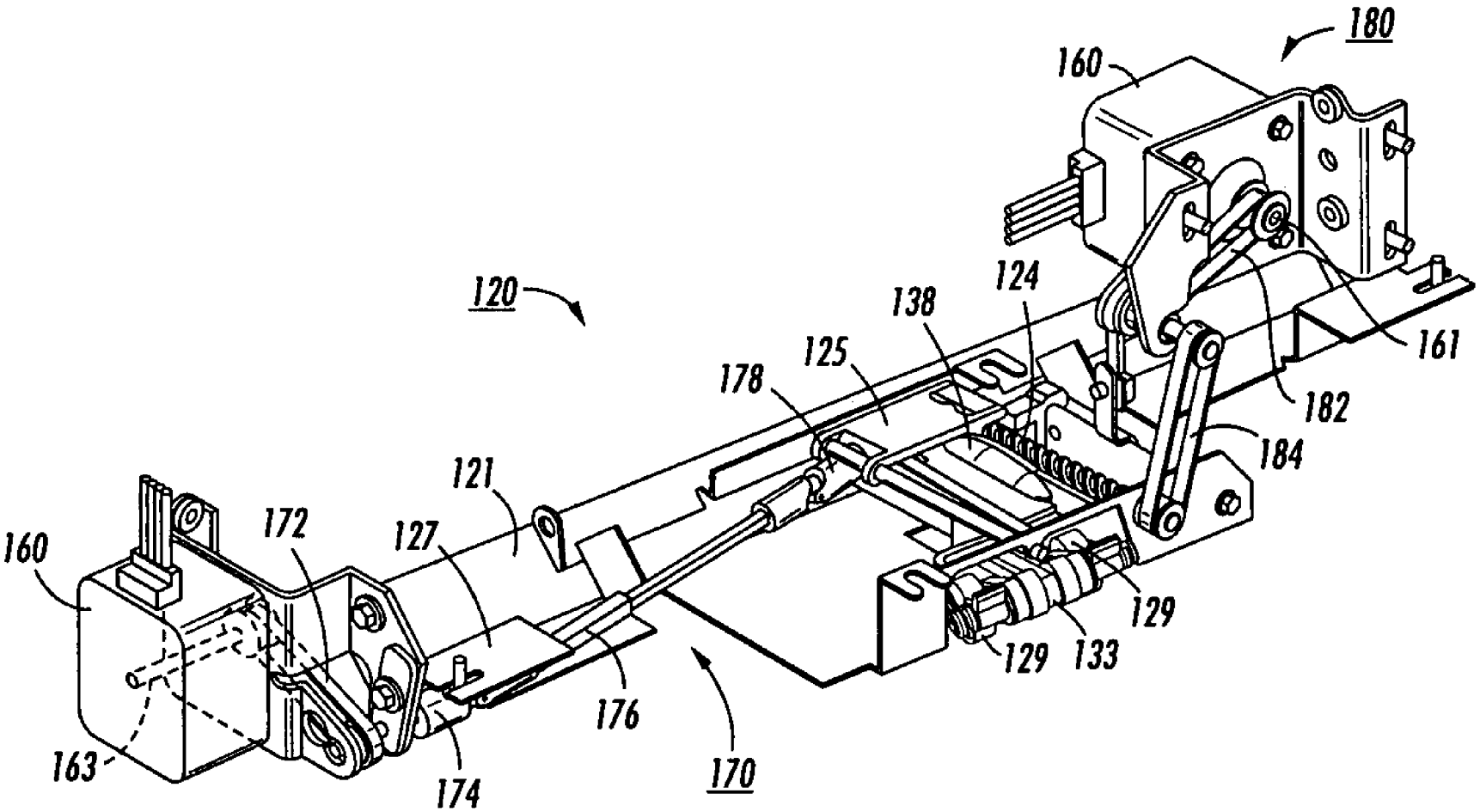
FIG. 4 shows in greater detail a first exemplary embodiment of a retractable scuffer registration device of the present disclosure where the retractable scuffer registration device has been retracted.

FIG. 3 shows in greater detail one exemplary embodiment of the scuffing system 120. As shown in FIG. 3, the scuffing system 120 includes a support frame 121, a scuffer arm 122, a lead screw 124 and a threaded slide 125 connected to the scuffer arm 122. One or more friction wheels 129 are attached to the scuffer arm 122. In FIG. 3, the scuffer arm 122 is in the extended position, where the one or more friction wheels 129 are placed on scuffing platform 190. FIG. 4 shows the exemplary embodiment of the scuffer system 120 of FIG. 3 with the scuffer arm 122 in a retracted position.

Figure 6:
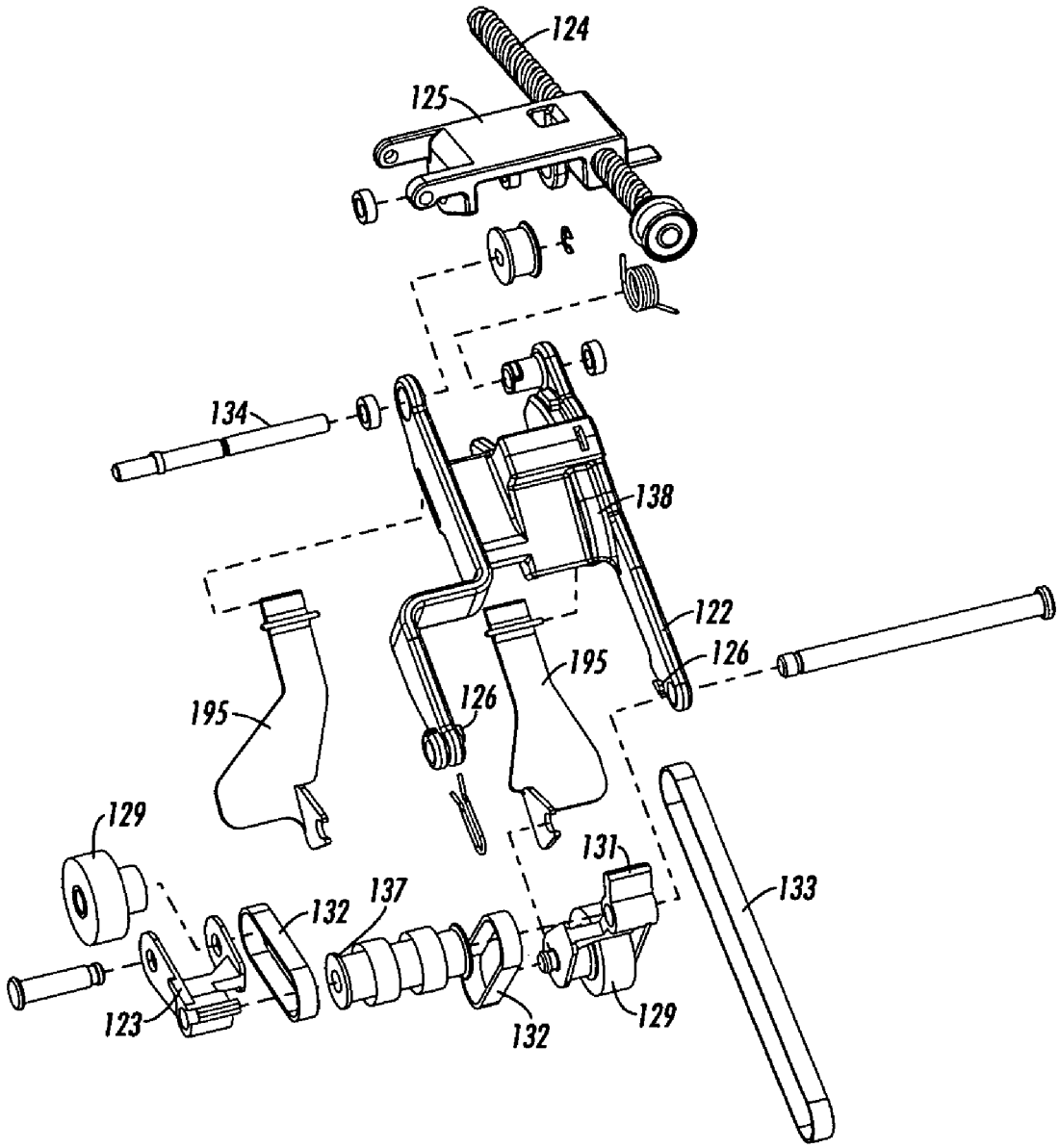
FIG. 6 is an exploded view showing in greater detail a first exemplary embodiment of the scuffer and threaded slide of the first exemplary embodiment of the retractable scuffer registration device according to the present disclosure.

As shown in FIG. 3, the scuffer arm 122 also includes a main drive belt 133 and secondary belts 132 connected to drive wheels 129 through idler 137 in FIG. 6. The scuffing system 120 also includes a drive system 160 comprising a pair of drive motors 161 and 163, and a first drive transfer system 180 comprising a first drive belt 182 and a second drive belt 184 that connects the drive motor 161 to the lead screw 124. A second drive transfer system 170 includes a third belt 172, a pair of universal joints 174 and 178 and a shaft 176 to connect the second drive motor 163 to the belt 133.

As shown in FIG. 3, the scuffing system 120 utilizes the lead screw 124 and the threaded slide 125 to lower the scuffer arm 122 into scuffing position. In particular, the first motor 161 of the drive system 160 is operated in an extension direction to rotate the belts 182 and 184 of the first drive transfer system 180. The motor 161 of the first drive transfer system 180, via a pulley, drives the belt 182 which, by a set of pulleys, is connected to and drives the belt 184, causing the belt 184 to rotate. The belt 184 is connected to the lead screw 124 by yet another pulley. The rotation of the belt 184 in the extension direction causes the lead screw 124 to rotate in the extension direction. As a result, the threaded slide 125, which is threaded onto the lead screw 124, moves to the extended position shown in FIG. 3 from the retracted position shown in FIG. 4. As depicted in FIG. 3, this in turn extends the scuffer arm 122 in a motion that brings scuffer arm 122 and the friction wheels 129 towards, and intimately into contact with a top surface of a sheet to be scuffed.

At the same time, or at some earlier or later time, that the first motor 161 of the drive subsystem 160 is operated in an extension direction, the second motor 163 of the drive system 160 operates to rotate the belt 133 and drive the friction wheels 129. The motor 163 drives the third belt 172, which is connected to the first universal joint 174. The first universal joint 174 is connected to the second universal joint 178 by the shaft 176, which is held in place by the guiding plate 127 of the support frame 121. The second universal joint 178 is in turn connected to a drive shaft 134 (shown in FIG. 6) of the scuffer arm 122.

As threaded slide 125 moves from an initial retracted position shown in FIG. 4 to the extended inclined position in FIG. 3, the scuffer arm 122 is supported and guided in the manner discussed below. One end portion of the scuffer arm 122 is pivotally connected to the threaded slide 125 via the drive shaft 134. When the threaded slide 125 moves between the extended position and the retracted position, the scuffer arm 122 pivots about the drive shaft 134.

Figure 7:
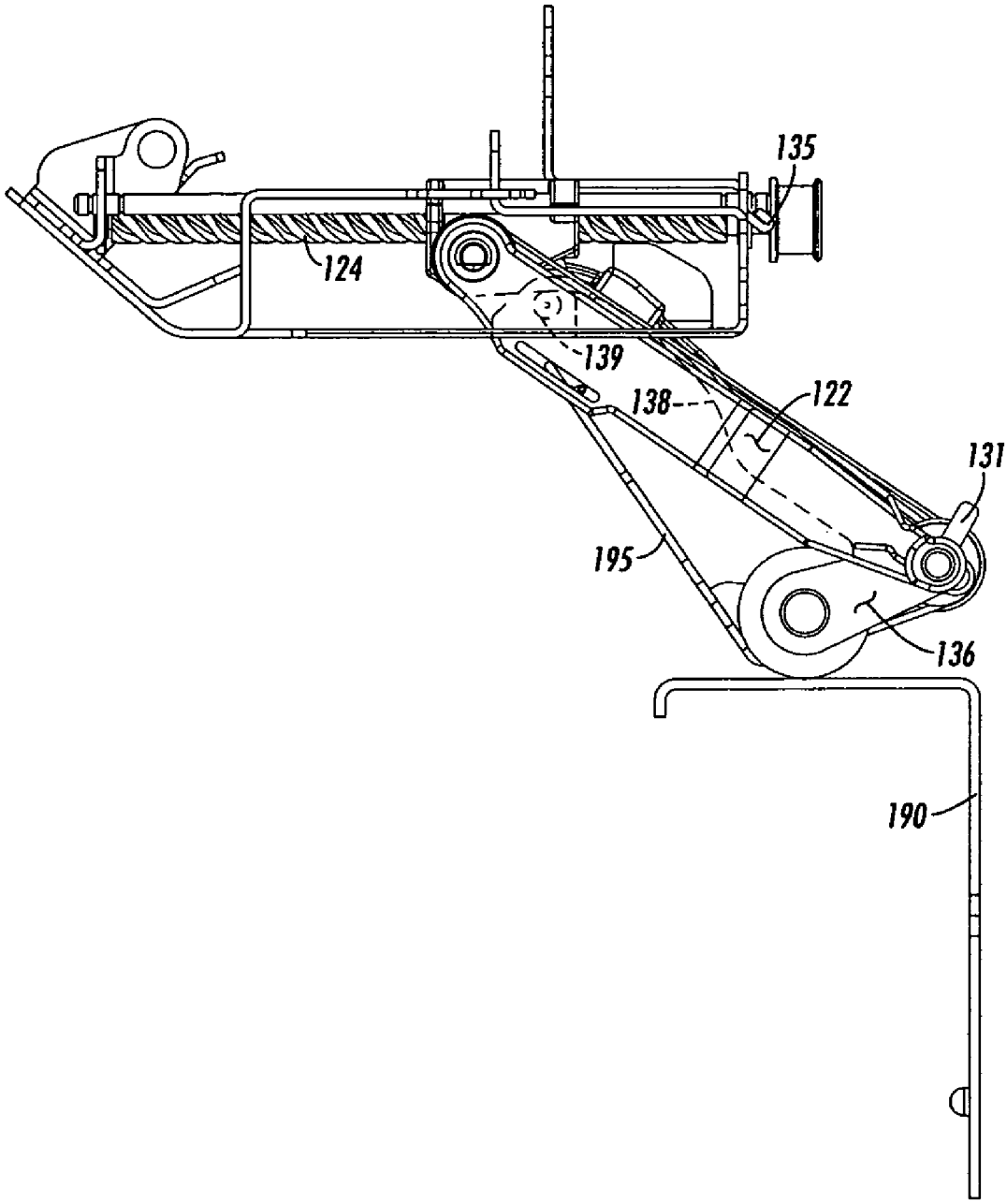
FIG. 7 is an elevation view of the scuffer and threaded slide of the first exemplary embodiment of the retractable scuffer registration device according to the present disclosure.
Figure 8:
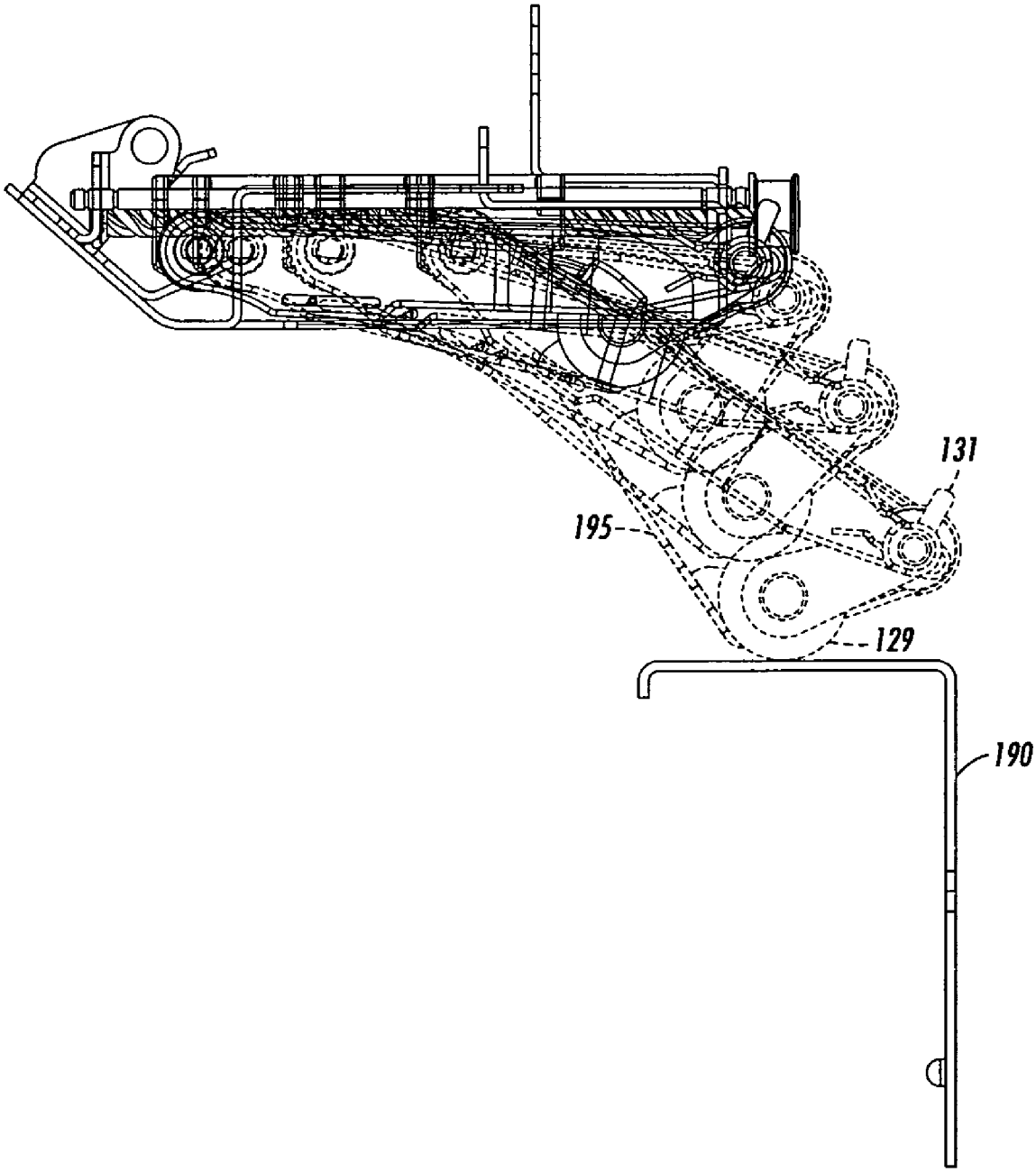
FIG. 8 is an elevation view of the scuffer and threaded slide of the first exemplary embodiment of the retractable scuffer registration device according to the present disclosure showing the scuffer in descend and retract motion.

As the scuffer arm 122 is extended, sheet guide 195 is automatically positioned in the paper path, lever 131 is released from contact members 135 allowing a friction wheel assembly that includes friction wheels 129 to pivot freely as shown in sequence in FIG. 8 until catch 123 on the friction wheel assembly hits stop 126 on scuffer arm 122 shown more clearly in FIG. 6, and subsequently, a sheet to be scuffed is caught between the friction wheels 129 and scuffer platform 190 with wheels 129 in a position as shown in FIG. 7. The friction wheels 129 thus engage the sheet and, driven by the second drive motor 163, the second drive transfer system 170 and the belt 133, pull the sheet forward to registration gate 115 of FIG. 2.

When withdrawal of the scuffer arm is required, the first drive motor 161 is operated to drive the first drive transfer system 180 in the opposite, or retraction direction, the threaded slide 125 also slides along the lead screw 124 in the opposite, or retraction, direction. As the threaded slide 125 slides in the retraction direction, the scuffer arm 122 is pulled from the extended position to the retracted position as shown in FIG. 4.

FIGS. 5-10 show the scuffer arm 122 and related portions of the support frame 121 and the second drive transfer system 170 in greater detail. As shown in FIGS. 3-10, the scuffer arm 122 also includes a cam portion 138, which controls the angle of orientation of the scuffer arm 122 as it is extended and retracted. As shown in FIGS. 5-10, the cam portion is located on a surface of the scuffer arm 122 opposite the belt 133. The cam portion 138 includes a recessed, arched surface located on a bottom surface (shown as a hidden line in FIG. 7) of the scuffer arm 122. As the threaded slide 125 moves between the extended position and the retracted position, the recessed arched portion of the cam portion 138 engages with a roller bearing 139, which is shown most clearly in FIG. 7. Thus, the arched surface of the recessed, arched cam portion 138 rolls past the roller bearing 139 to support and guide the scuffer arm 122 as it is being retracted to or extended from the support frame 121.

The roller bearing 139 supports and guides the cam portion 138 as the scuffer arm 122 is extended. The roller bearing 139 also support and guides the cam portion 138 causing the scuffer arm 122 to rise away from the sheet that has just been scuffed. So that the sheet is not caught between the friction wheels 129 and the scuffer platform 190 and brought out of registration. In particular, the friction wheels 129 are rapidly vertically disengaged from the sheet while the scuffer arm 122 is translated horizontally. Because the friction wheels 129 are disengaged from the sheet, the sheet is not inadvertently withdrawn by the friction wheels 129 while the scuffer arm 122 is being withdrawn.

Figure 9:
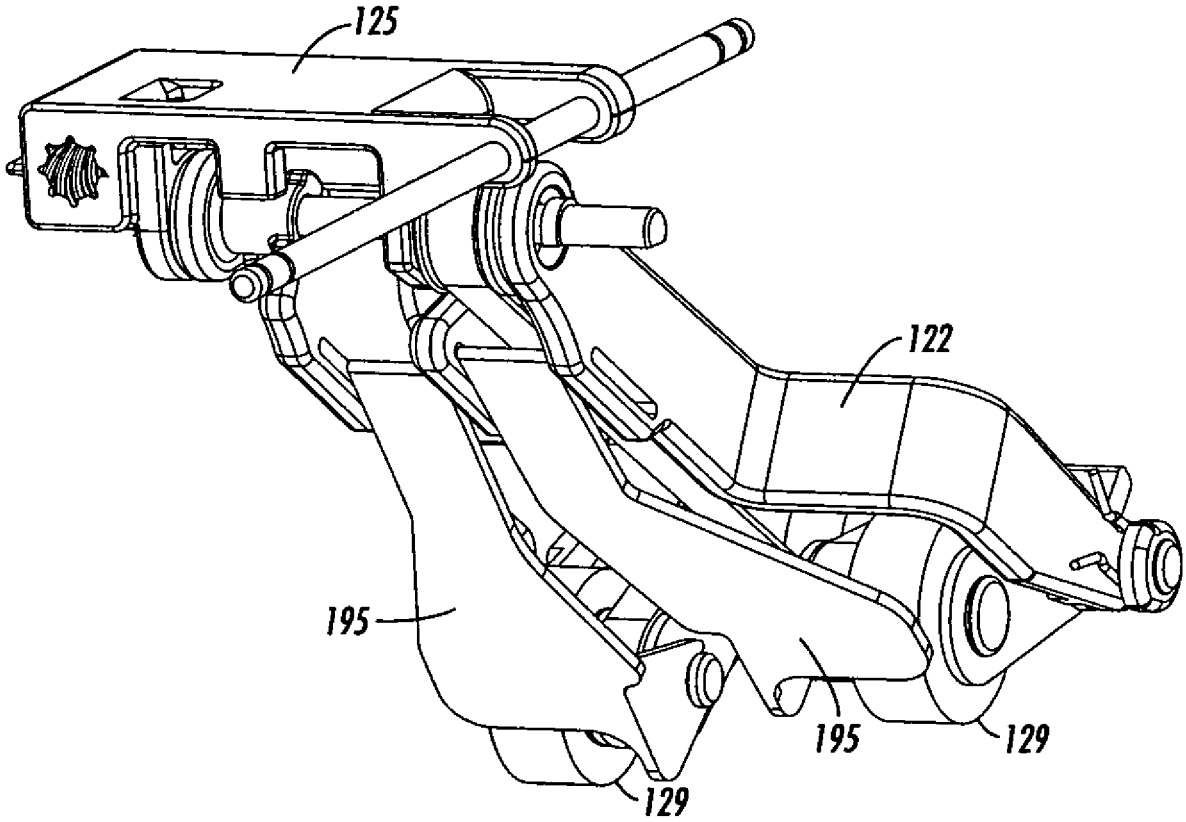
FIGS. 9 and 10 are partial isometric views of the scuffer registration device according to the present disclosure showing the free rotation of independently suspended drive wheels.
Figure 10:
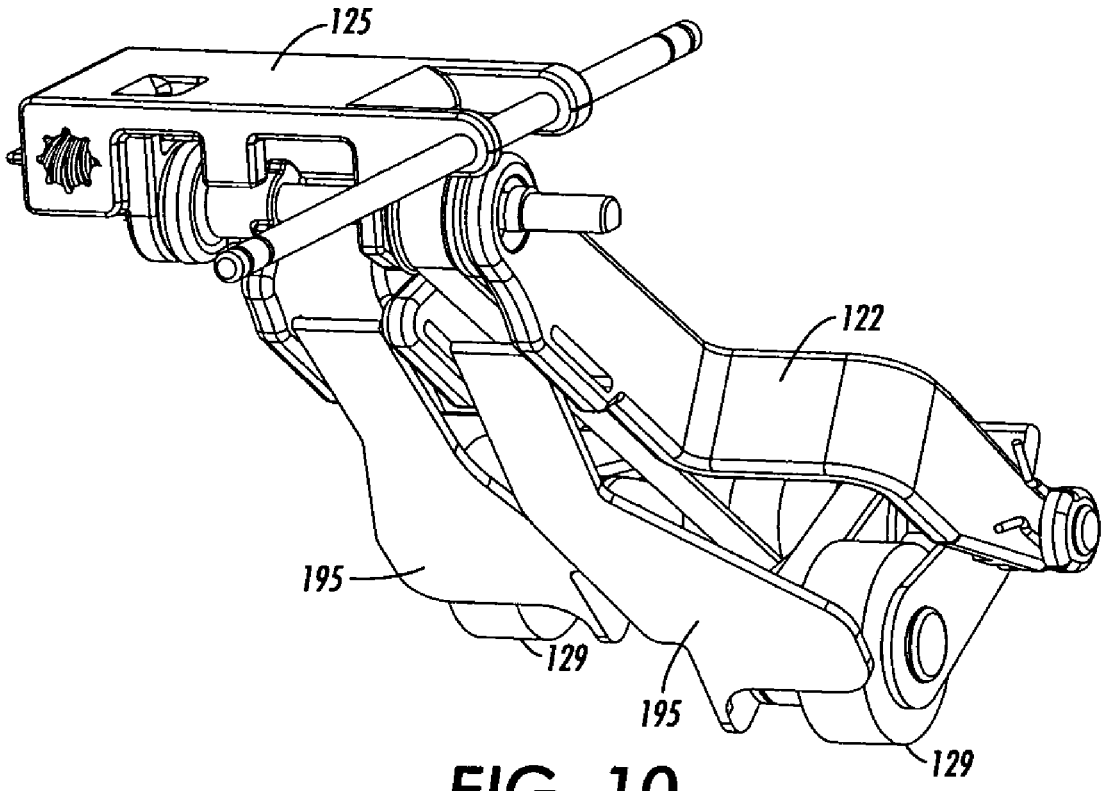

In order to accommodate tight space constraints in some machine paper path architectures and to allow drive wheels 129 to contact sheets at an angle that allows the sheets to be pulled as oppose to pushed into registration gate 115, drive wheels 129 are foldable and independently suspended, as shown in FIGS. 9 and 10, and designed to flip down in a counter clockwise direction to take up any unevenness on the contact surface. For example, in FIG. 9, inboard drive wheel 129 is independently suspended down while the outboard drive wheel is up and in FIG. 10, outboard drive wheel 129 is independently suspended down while the inboard drive wheel is up. If there is no unevenness in the contact surface both drive wheels will be in the same plane, but any unevenness in the contact surface will automatically be compensated for since the drive wheels are independently suspended. The flip down motion provides a much shallower angle of contact with sheets that is ideal for scuffing and facilitates pulling sheets into registration rather than pushing them into registration as done presently, thus eliminating unwanted reaction forces created by pushing sheets against a registration gate, while at the same time, ensuring constant nip force during scuffing.

It should be appreciated that the shape and design of the first and second universal joints 174 and 178, the design of the scuffer arm, and/or the design of the friction wheels 129 are design choices that will be obvious and foreseeable to those skilled in the art. It should also be appreciated that any other known or later-developed mechanism can be used in place of the lead screw 124 and threaded slide to extend/retract the scuffing arm 122. It should be further appreciated that any known or later-developed mechanism and design of the cam portion 138 of the scuffer arm 122, the roller bearing 139 and the connection of the scuffer arm 122 to the threaded slide 125 can be used to support and guide the scuffer arm 122 from an initial retracted position to an inclined extended position.

Figure 5:
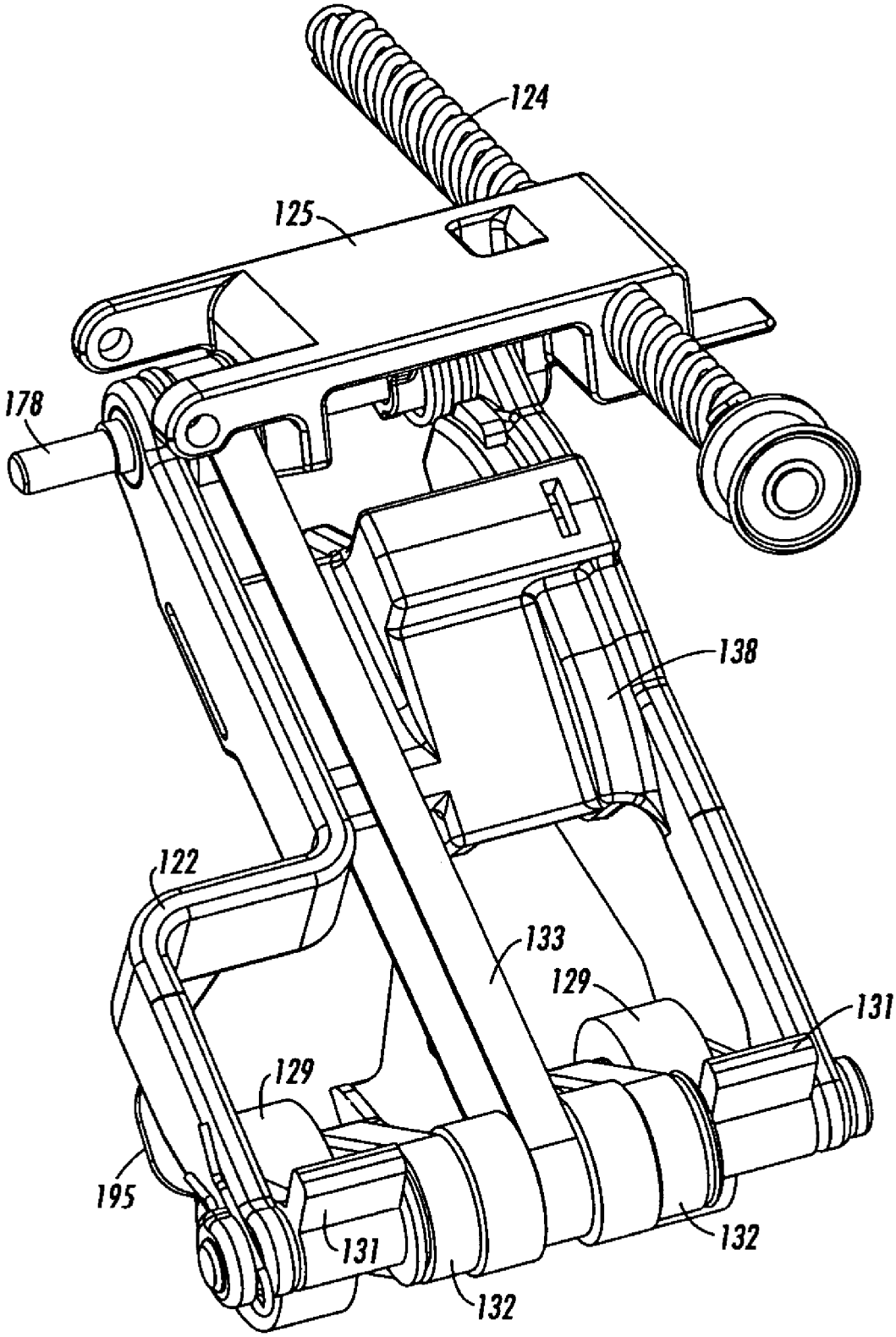
FIG. 5 is a plan perspective view showing the first exemplary embodiment of the scuffer registration device of FIGS. 3 and 4.

In operation, a sheet is received by the compiling platform 114 via one of the gates 107. The scuffing system 120 extends the scuffer arm 122 to pull the sheet forward to ensure the leading edge of the sheet is aligned with, or registered against the lead edge registration gates 115, or optionally, a manipulation device 130 (if provided). The scuffer arm 122 may be raised and retracted, enabling conventional tampers to be engaged. In general, the scuffing system 120 operates as the sheet registration device in the process direction while the tampers are used for cross-process-direction registration. The process of alternating scuffing and tamping to register sheets enables the registration of sheet sets of different sizes. However, it should be appreciated that the combination of scuffing and tamping can be altered and combined in a manner that is suitable to the process desired. As shown in FIGS. 5 and 7, the scuffer arm 122 travels along the lead screw 124. As it descends down onto its scuffing platform 190, levers 131 disengage from the contact members 135 allowing the drive wheels 129 to flip down into their scuffing position while, at the same time, pulling down paper guide 195.

It should now be understood that an improved scuffing mechanism has been disclosed that is able to operate within space constraints of present copier/printers by providing a scuffing mechanism such that as the scuffing mechanism projects down into the paper path, two drive wheels with independent suspension flip down and take up any unevenness on the contact surface. They flip down in a counter clockwise direction landing on the scuffing surface awaiting paper to register. This flip down motion provides a much shallower angle ideal for scuffing and also allows paper to be pulled against the registration gates, as opposed to, being pushed as in systems heretofore. Changing the "push" to "pull" configuration eliminates an unwanted reaction force inherent in existing push configurations.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A reprographic device, comprising:

an image forming apparatus for forming an image on a copy sheet in a sheet processing module;

a compiling module usable to compile at least one copy sheet, said compiling module including; a sheet transport system that transports sheets received from said image forming device; a compiling tray that receives copy sheets from said sheet transport system; and a scuffin apparatus including a scuffer arm pivotally mounted on a first shaft at a first end thereof and a second shaft mounted on a second end thereof downstream of said first shaft with foldaway drive wheels mounted on separate shafts and connected thereto, said foldaway drive wheels being independently suspended, and wherein said drive wheels are housed in a drive wheel assembly, and wherein said drive wheel assembly is mounted on said second shaft to pivot about said second shaft and is released from a folded position to an unfolded position on top of copy sheets in said compiling tray through pivoting of said drive wheel assembly due to gravity in an arcuate path in the sheet transport direction so as to allow said drive wheels to reposition downwardly at an angle with respect to said compiling module which will allow pulling of said copy sheets in said compiling module against a registration gate.

2. The reprographic device of claim 1, wherein said scuffing apparatus includes at least one foldaway sheet guide, and wherein said at least one foldaway sheet guide is simultaneously placed into position to be contacted by and guide copy sheets in the sheet transport direction with the release of said drive wheel assembly from said folded position.

3. The reprographic device of claim 1, wherein said drive wheels are held in a retracted position by contact members, said contact members being positioned downstream of said second shaft of said drive wheel assembly is in said folded position.

4. The reprographic device of claim 3, wherein manipulation of said lead screw releases said drive wheels from said contact members.

5. The reprographic device of claim 4, including lever members integrally connected to said drive wheel assembly, and wherein manipulation of said lead screw in a second direction causes said scuffer arm to lift from a descended sheet contacting position to a retracted position causing said lever members to engage said contact members and restrain said drive wheels from pivoting.

6. A scuffing apparatus, comprising:

a scuffer arm pivotally mounted on a first shaft at one end thereof and including a second shaft positioned at a remote end thereof, said scuffer arm including foldable drive wheels mounted to pivot about said second shaft;

an extending and retracting device connected to said scuffer arm; and a drive system for manipulating said extending and retracting device between a first extended position that releases said foldable drive wheels of said scuffer arm from a retention device to pivot in an arcuate path in the direction of sheet transport from a folded position into a copy sheet scuffing position, and in a second retracted position wherein said drive wheels of said scuffer arm are pivoted away from the copy sheet scuffing position into said folded position, said retention device being positioned at said remote end of said scuffer arm.

7. The scuffing apparatus of claim 6, wherein said drive wheels are independently suspended.

8. The scuffing apparatus of claim 7, wherein said extending and retracting device comprises a lead screw.

9. The scuffing apparatus of claim 8, wherein said drive wheels are held in a retracted position by contact members, said contact members being positioned downstream of said remote end of said scuffer arm.

10. The scuffing apparatus of claim 9, wherein manipulation of said lead screw releases said drive wheels from said contact members.

11. The scuffing apparatus of claim 10, including lever members integrally connected to a support of said drive wheels, and wherein manipulation of said lead screw in a second direction causes said scuffer arm to lift from a descended sheet contacting position to a retracted position and thereby causing said drive wheels to be restrained by said contact members.

12. A reprographic device, comprising:

an image forming apparatus for forming an image on a copy sheet in a sheet processing module;

a compiling module usable to compile at least one copy sheet, said compiling module including;

a sheet transport system that transports sheets received from said image forming device;

a compiling tray that receives copy sheets from said sheet transport system; and a scuffin apparatus including a scuffer arm pivotally mounted on a first shaft at a first end thereof and a second shaft mounted on a second end thereof downstream of said first shaft with foldaway drive wheels mounted on separate shafts, said foldaway drive wheels being independently suspended, wherein said drive wheels are housed in a drive wheel assembly, and a retention system for retaining said drive wheels in a folded position above said tray and for lowering said drive wheels from said folded position to an unfolded position through pivoting of said drive wheel assembly on said second shaft through an arcuate path in the direction of sheet transport so as to allow said drive wheels to reposition downwardly at an angle with respect to said compiling tray which will allow the moving of copy sheets in said tray against a registration gate with said drive wheels, said retention system being positioned downstream of said second shaft.

* * * * *